US006196336B1

(12) United States Patent
Fincher et al.

(10) Patent No.: US 6,196,336 B1
(45) Date of Patent: Mar. 6, 2001

(54) METHOD AND APPARATUS FOR DRILLING BOREHOLES IN EARTH FORMATIONS (DRILLING LINER SYSTEMS)

(75) Inventors: Roger Fincher, Conroe; Larry Watkins, Houston, both of TX (US); Friedhelm Makohl, Hermannsburg; Detlef Hahn, Hannover, both of (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/205,969

(22) Filed: Dec. 4, 1998

Related U.S. Application Data

(63) Continuation-in-part of application No. 08/729,226, filed on Oct. 9, 1996, now Pat. No. 5,845,722.

(30) Foreign Application Priority Data

Oct. 9, 1995 (EP) ..... 95116867

(51) Int. Cl.[7] ..... E21B 7/20
(52) U.S. Cl. ..... 175/101; 175/171; 175/257
(58) Field of Search ..... 175/101, 106, 175/107, 251, 171, 23, 257

(56) References Cited

U.S. PATENT DOCUMENTS

| | | | | |
|---|---|---|---|---|
| 3,732,143 | * | 5/1973 | Joosse | 175/101 X |
| 3,901,331 | * | 8/1975 | Djurovic | 175/101 X |
| 4,281,722 | * | 8/1981 | Tucker et al. | 175/57 |
| 4,842,081 | * | 6/1989 | Parant | 175/101 X |
| 5,074,366 | * | 12/1991 | Karlsson et al. | 175/76 |
| 5,186,265 | | 2/1993 | Henson et al. | 175/107 |
| 5,197,553 | | 3/1993 | Leturno | 175/57 |
| 5,472,057 | * | 12/1995 | Winfree | 175/101 X |
| 6,024,168 | * | 2/2000 | Kuck et al. | 166/297 |

FOREIGN PATENT DOCUMENTS

| | | |
|---|---|---|
| 3839 760 | 1/1990 | (DE) . |
| 3902 868 | 6/1990 | (DE) . |
| 0 265 344 | 4/1988 | (EP) . |
| 0 462 618 | 12/1991 | (EP) . |

* cited by examiner

*Primary Examiner*—Frank Tsay
(74) *Attorney, Agent, or Firm*—Madan, Mossman & Sriram, P.C.

(57) ABSTRACT

A drilling liner having a core bit at its bottom end is carried along with a pilot bit on an inner bottom hole assembly driven by a downhole mud motor. In one embodiment, the motor is powered by mud carried by an inner string. Alternatively, the inner string may be omitted and the flow of mud through the liner powers the motor: this requires a locking tool for locking the motor assembly to the outer assembly. Once an abnormally (high or low) pressured zone has been traversed, the liner is set as a casing, the inner assembly is pulled out, and drilling may be resumed using a conventional tool. Directional drilling is accomplished by having an MWD device for providing directional information and having directional devices on the inner and outer assembly. These include retractable steering pads. Expandable bits, under-reamers and jetting nozzles may also be used in the drilling process. One embodiment of the invention has a bottom thruster between the mud motor and the drill bits that makes it possible to continue drilling for a limited distance even if the upper portion of the casing is stuck.

33 Claims, 10 Drawing Sheets

METHOD AND APPARATUS FOR DRILLING BOREHOLES IN EARTH FORMATIONS (DRILLING LINER SYSTEMS)

CROSS REFERENCES TO RELATED APPLICATIONS

This application claims priority from the EP application, Application Number 95116867.4, filed with the European Patent Office on Oct. 9, 1995. It is a continuation-in-part of U.S. patent application Ser. No. 08/729,226 filed on Oct. 9, 1996, now U.S. Pat. No. 5,845,722.

FIELD OF THE INVENTION

The invention relates to a method of and an apparatus for drilling a borehole in underground formations with at least one formation that has a significantly different formation pressure than an adjacent formation or where time dependent unstable formations do not allow sufficient time to case off the hole in a subsequent run.

BACKGROUND OF THE INVENTION

A collapsed hole adds great expense to the drilling of a wellbore and can lead to the abandonment of the hole. Hole collapse can be caused by a number of drilling conditions including shale swelling, sloughing, and unconsolidated sands that cause a hole to wash out or collapse as soon as it is drilled. In these unstable formations, the bore hole can not be cased off and protected in time, when running a liner in a subsequent run after the hole was drilled.

Another cause of wellbore/hole collapse is an extreme pressure drop between adjoining formations. Drilling into a low pressure formation with a heavy mud that is designed to drill through an overlying high pressure zone will result in severe mud losses and simultaneous hole collapse. An opposite situation is encountered when a borehole is drilled through a first formation having a low formation pressure into a formation of substantially higher formation pressure, then there is the danger of fluids from the lower formation entering the borehole and damaging the upper formation. If the pressure difference is large enough, there is a risk of a blowout. If the mud weight is increased to prevent such a blowout, then the mud can damage the low pressure formation.

There is a need for an apparatus and method of drilling boreholes that avoids these problems. Such an invention should preferably reduce the operational time in its use. It should preferably be adaptable for use with directional drilling systems. It should reduce the exposure of the formations to the dynamic circulation pressure of the drilling mud and thereby reduce formation damage. A further desirable aspect is ro reduce the likelihood of getting stuck in the borehole. In addition, if the apparatus does get stuck, it should be possible to continue drilling ahead. The present invention satisfies this need.

SUMMARY OF THE INVENTION

The present invention is an apparatus and method for drilling through formations in which the pressure is significantly different from the pressure in the adjacent formations, and/or unstable formations make it difficult to protect the formation with a liner or casing in the hole. The drilling liner system consists of an inner string carrying an inner assembly having a pilot bit, and an outer assembly having a core bit. Both assemblies are temporarily connected via retractable splines that ensure that the inner and outer assemblies are properly aligned with each other. When running in the hole, the splines are retracted and, upon reaching the proper alignment, extend automatically. After the liner is set, the process of pulling the inner string from the liner forces the splines to retract once again. One embodiment of the invention is a system in which there is no inner string between the bottom hole assembly and the liner hanger. Besides eliminating the trip time for the inner string, this makes it possible to fish the bottom hole assembly out of the hole with a jointed pipe or a wireline. Another embodiment of the invention has a steerable drilling liner, the steering being accomplished by a tilted joint, or with steering pads. Another embodiment of the invention has a sealed annulus between the open hole and the liner. This isolates the open hole from the dynamic pressure of the circulating mud system. Yet another embodiment of the invention incorporates a reamer on the outer part of the liner to enlarge the hole and thereby reduce the risk of getting stuck. An expandable core bit or pilot bit may be used to provide a similar result. Another embodiment of the invention makes it possible to do some additional drilling even after getting stuck. In another embodiment of the invention, high pressure jetting nozzles are used with the pilot bit to enlarge the hole and reduce the risk of getting stuck. Instead of drilling pipe, the drilling liner can be used with coiled tubing.

BRIEF DESCRIPTION OF THE FIGURES

FIG. 11 illustrates a situation in which the pilot bit of the invention of FIG. 10 rotates without the liner being rotated.

DETAILED DESCRIPTION OF THE INVENTION

Figure 1:
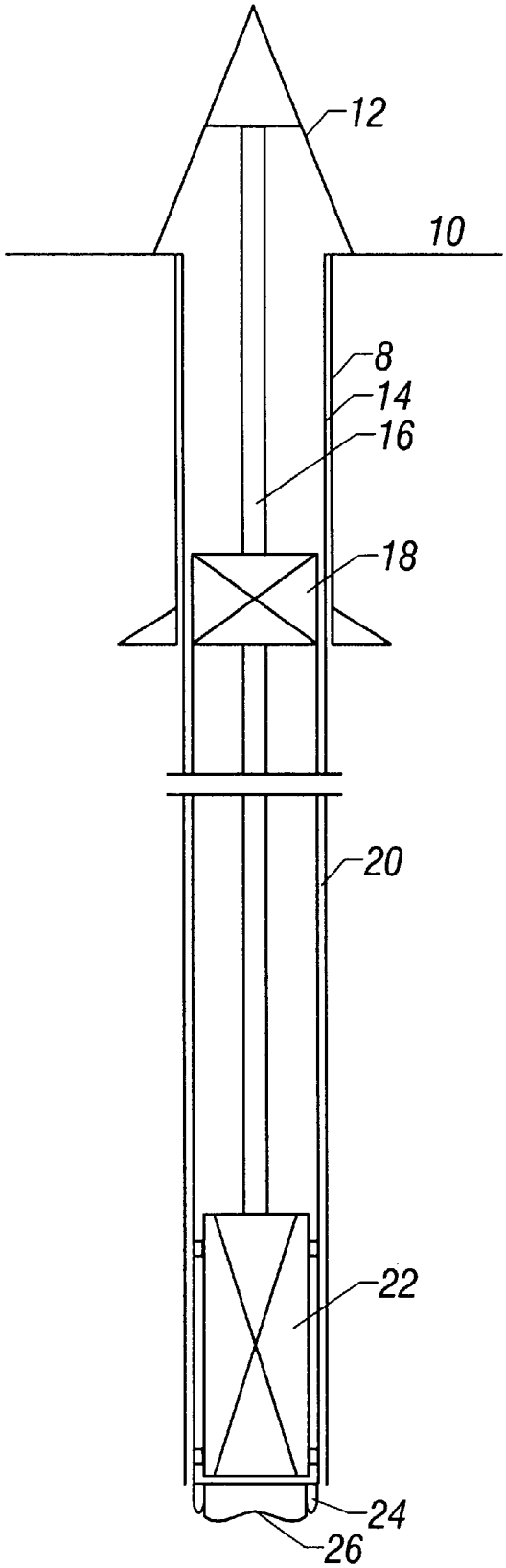
FIG. 1 shows an overall diagrammatic view of a drilling system with a drilling liner.

U.S. patent application Ser. No. 08/729,226 filed on Oct. 9, 1996, now U.S. Pat. No. 5,845,722, the contents of which are fully incorporated here by reference, discusses an apparatus and method of drilling boreholes in underground formations in which the formation pressures differ considerably. The drilling liner system consists of an outer an inner assembly. Both assemblies are temporarily connected via retractable splines that ensure that the inner and outer assemblies are properly aligned with each other. When running in the hole, the splines are retracted and, upon reaching the proper alignment, extend automatically. After the liner is set, the process of pulling the inner string from the liner forces the splines to retract one again.

The inner assembly consists of a pilot bit, a male sub, a downhole motor and a thruster or other device to provide the necessary weight on bit. The inner assembly's spline male sub houses the retractable drive splines, which transmit torque from the motor to the outer assembly's core bit. This means that the pilot bit and the core bit turn together at the same rate. The motor provides torque and rotation while the thruster provides a dynamic length suspension of the inner string with respect to the outer string. This allows the thruster to compensate for differential thermal expansion between the inner and outer assemblies. Additionally, the thruster provides the hydraulic weight on bit (WOB).

The outer assembly includes a core head, a female sub, a suspension sub (bearing sub) and a landing sub. The outer, lower assembly is connected via a crossover to a standard liner with required length. In addition to delivering the cutting action, the core head provides guidance for the inner assembly's pilot bit. The spline female sub forms a locking mechanism for the inner assembly's retractable male splines. The suspension sub offers longitudinal length suspension and delivers radial guidance. Axial forces (WOB) are transmitted to the inner string. Even though no axial bearing is required in the suspension sub, it can be installed, if liner size and drift offered sufficient wall thickness. The suspension sub also ensures that only the core bit and the female sub turn. If required, the rest of the assembly rotates at a lower RPM set at the surface. A liner hanger and running tool connect the inner and outer assemblies in the drilling mode. Following drilling, the liner hanger is set before the running tool is disconnected from the liner and the packer is set before the inner string is pulled out of the hole. The running tool which connects liner and the inner string is usually a part of the liner hanger. If using a single running tool, liner hanger and packer might not necessarily be required and the need for the liner hanger/packer will depend on the application. In the following discussion, embodiments of the invention are shown using a liner hanger, but it is to be understood that it may not be necessary in all cases. During drilling operations, drilling mud emerges from the end of the drill bit and passes into the bore hole so that it can subsequently flow back to the surface through the annular space between the drilling tool and the walls of the bore hole.

FIG. 1 shows a schematic illustration of an embodiment of the present invention for drilling a borehole using a drilling liner. Shown is a rig 12 at the surface 10 of the earth in which a borehole 8 is drilled. A casing 14 has been set in the upper portion of the borehole. A drilling tubular 16 passes through the casing to a liner hanger/packer 18 at the bottom of the cased portion of the hole and carries a drilling liner—bottom hole assembly (DL-BHA) 22 at its lower end. The DL-BHA has, at its bottom end, a pilot bit 26 and a core bit 24. A liner 20 hangs from the liner hanger 18 at its top end is connected to the DL-BHA at its bottom end. The drilling tubular may be a drill pipe or coiled tubing.

The liner hanger 18 connects the inner string, the outer line assembly and the drill pipe running string for the drilling mode. After completion of drilling, the liner hanger is set and the running tool disconnects from the liner. Desirable features for the liner hanger are:

(i) Quick and reliable hydraulic setting function that is insensitive to circulating pressure while drilling (ii) Releasing function that is independent of the setting function.

(iii) All hanger sealing components suitable for handling extreme external pressure differentials resulting from internal pipe evacuation.

(iv) Capability to circulate through the inner string (discussed below) after releasing from the liner.

(v) Capability to run wireline perforators or back off tools below the hanger to allow fishing in case the inner string becomes stuck.

(vi) Capability to allow surface rotation and sufficient torque resistance.

Figure 2A:
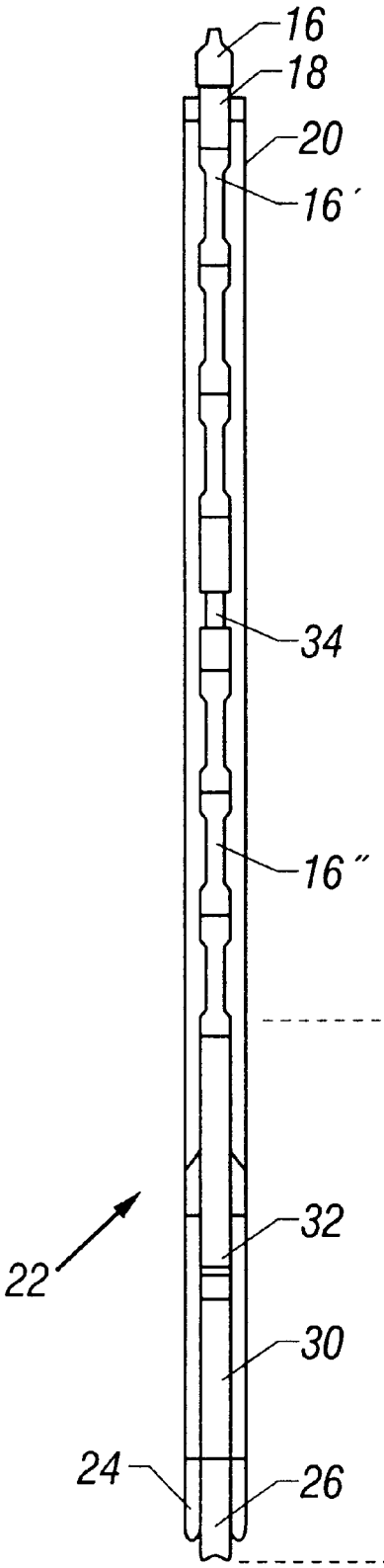
FIGS. 2A, 2B show details of the Drilling Liner Bottom Hole Assembly (DL-BHA).
Figure 2B:
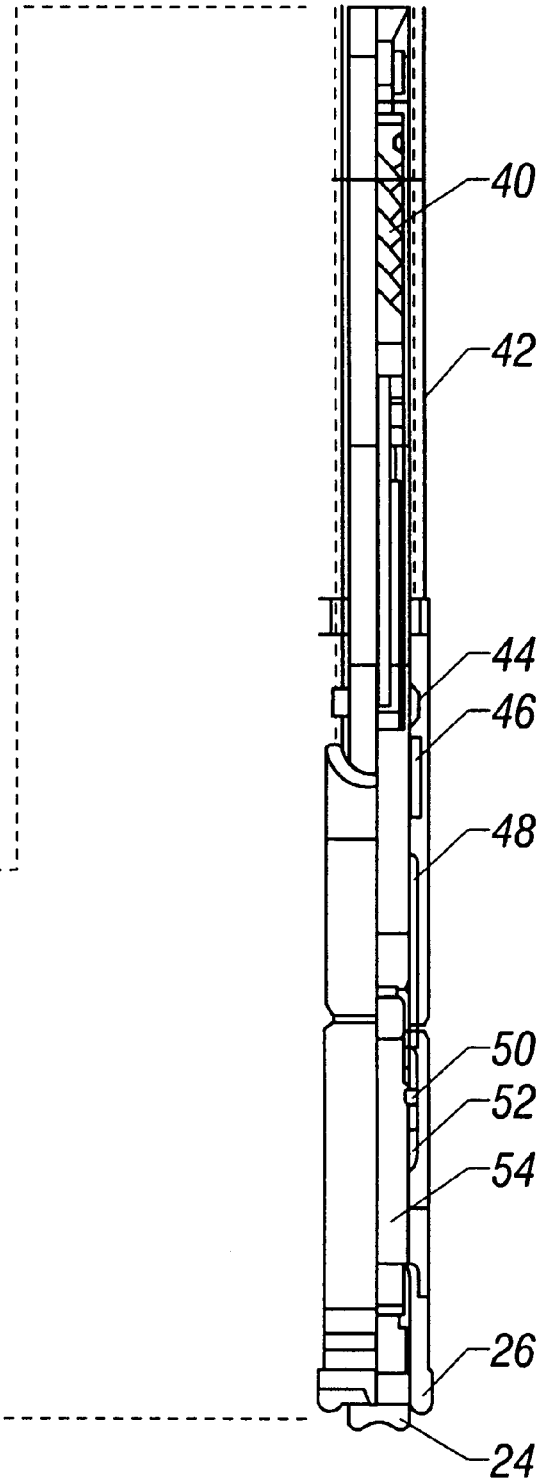

Details of the DL-BHA are shown in FIGS. 2A and 2B. Shown at the top of FIG. 2A is a drilling tubular 16 to the surface and the liner hanger 18. The drilling tubular 16' below the liner hanger 18 may be of a smaller size than above the liner hanger 18. A thruster 34 is connected to the drilling tubular 16' and a drilling collar 16" connects the thruster 34 to the drilling liner inner assembly 30 while the liner 20 is connected to the drilling liner outer assembly 32.

The drilling liner inner assembly 30 includes a drilling motor 40, the pilot bit 24, and a male sub 54 with drive splines 52 that transmit the torque from the motor 40 to the outer assembly. Landing splines 44 ensure a proper alignment of the inner assembly to the outer assembly. The outer assembly 32 includes the core bit 24, a landing sub 46, a suspension and bearing sub 48 and a female sub 50 that engages the drive splines 52. The suspension and bearing sub 48 provides longitudinal length suspension and radial guidance and ensure that only the female sub 50 and the core bit 26 turn and the rest of the outer assembly remains without rotation.

The downhole motor 40 provides the cutting torque and rotation. The thruster 34 provides a hydraulic weight on bit (WOB) and a dynamic length suspension.

As discussed in U.S. patent application Ser. No. 08/729,226, a standard drilling BHA is used to drill to the vicinity of a potential problem zone without the liner. The standard BHA is retrieved and the drilling liner is run in hole to continue further drilling through the problem zone. Once the problem zone has been traversed, the liner is set and the inner string is retrieved. Drilling may then continue below the problem zone and if a second problem zone is encountered, the process may be repeated.

Figure 3:
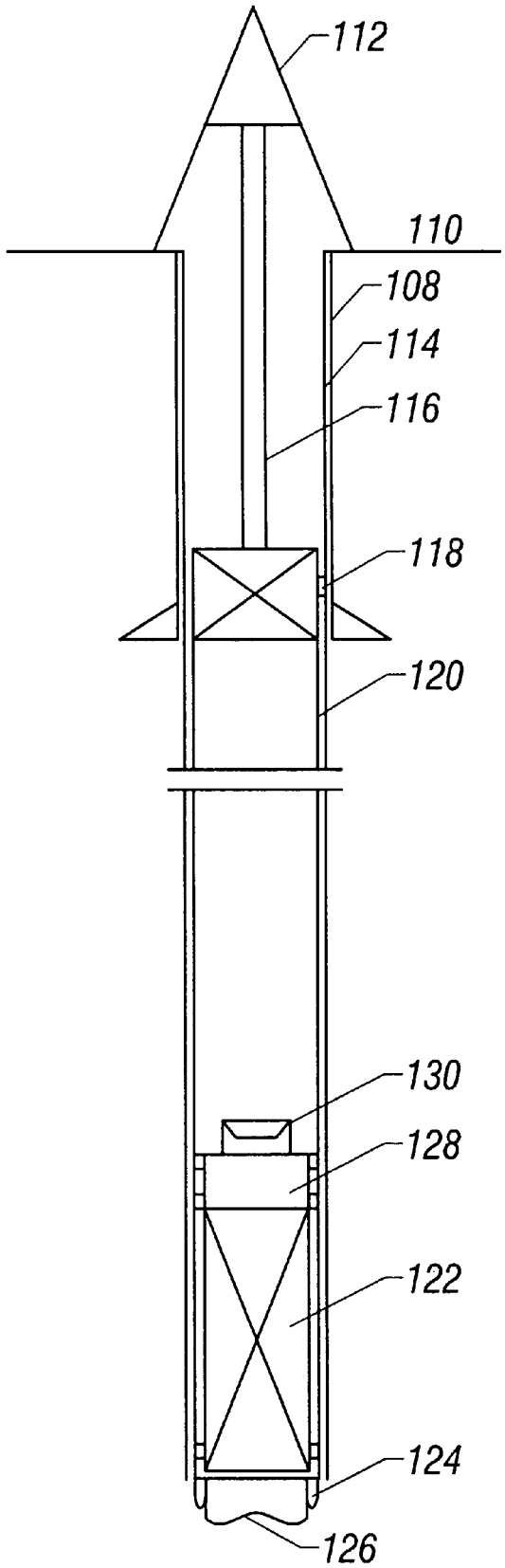
FIG. 3 is a schematic illustration of a modified DL-BHA without an inner string.

FIG. 3 shows a schematic illustration of a drilling liner system without the use of an inner string between the liner hanger and the DL-BHA motor. This eliminates the additional weight of the inner string to be carried by the rig. Furthermore it reduces the frictional forces between liner and hole when drilling in highly deviated hole sections. The maximum drilling distance in this kind of wells can be quite large. Shown is a rig 112 at the surface 110 of the earth in which a borehole 108 is drilled. A casing 114 has been set in the upper portion of the borehole. A drilling tubular 116 passes through the casing to a liner hanger 118 at the bottom of the cased portion of the hole. A liner 120 hangs from the liner hanger 118 at its top end is connected to the DL-BHA 122 at its bottom end. The DL-BHA has, at its bottom end, a pilot bit 126 and a core bit 124. These are as discussed above with reference to FIG. 1.

A landing sub is not necessary because the DL-BHA 122 is temporarily connected to the lower part of the liner 120 by means of a releasing tool 128. An inner string between the liner hanger 118 and the DL-BHA 122 is not required. The top of the releasing tool is provided with a fishable joint 130 that makes it possible to fish the DL-BHA 122 after the liner hanger/packer 118 is set.

Figure 4A:
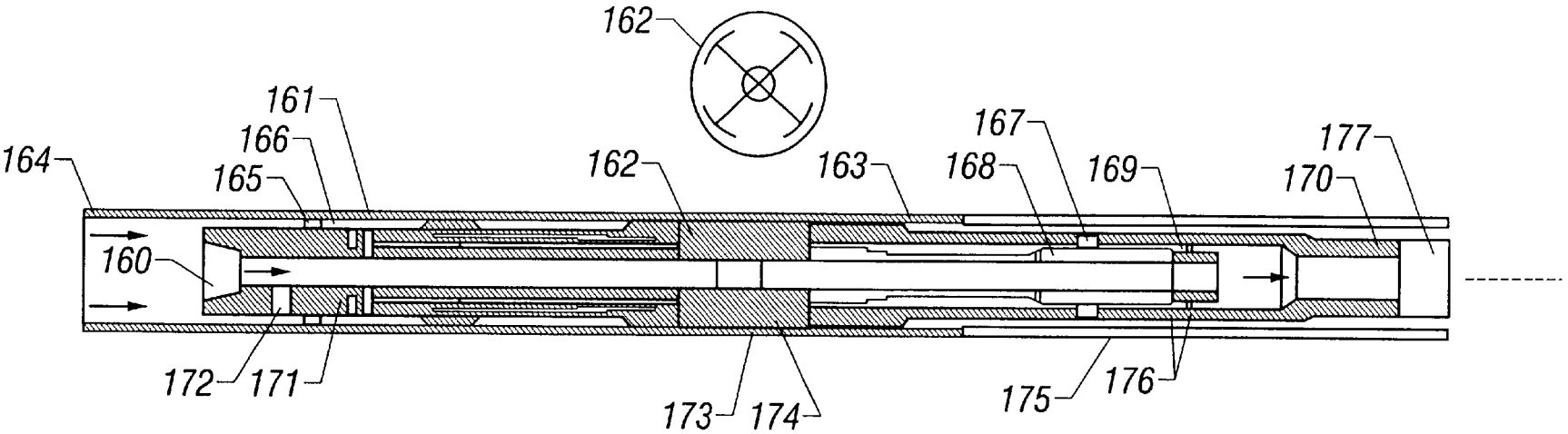
FIG. 4 shows details of the releasing tool used in the DL-BHA of FIG. 3.
Figure 4B:
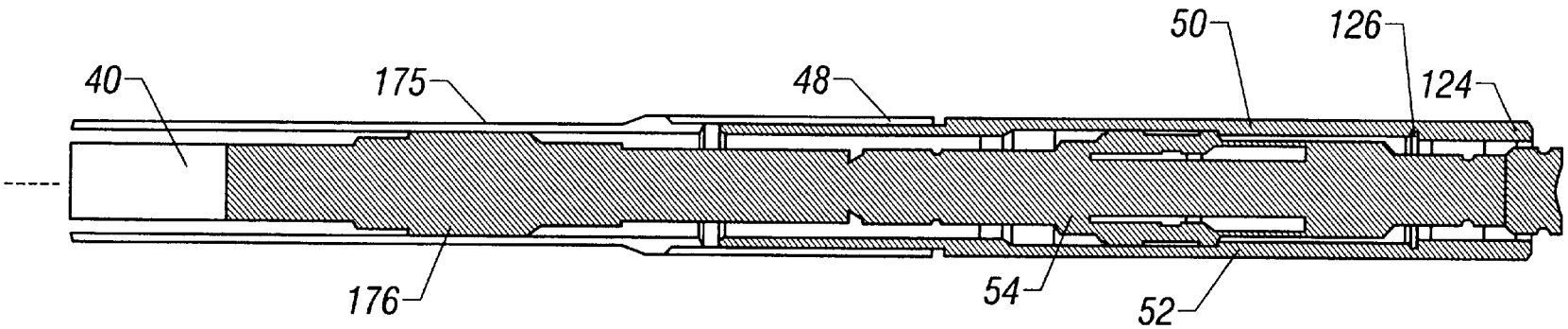

FIG. 4 shows details of the DL-BHA with releasing tool 128. The BHA is connected to the Liner as shown in FIG. 3 using the upper liner connection 164. In contrast to the assembly discussed in FIG. 2, instead of the landing sub a cross over sub 175 is used to connect the outer part of the releasing tool to the outer portion of the lower drilling liner. The BHA has on it's bottom end a pilot bit 124, core bit 126, female sub 50, male sub 54, drive splines 52 and a downhole motor 40 as discussed under FIG. 1. Instead of a motor with special bearing housing (featuring the landing splines), a standard available downhole motor can be used. The motor features a screw on stabilizer 176 for centralization of the inner string inside the outer string.

FIG. 4A shows details of the releasing tool. Instead of the shown Releasing Tool also standard components like e.g. a Baker Oil Tools sealing sub and running tool can be used. The preferred embodiment of the releasing tool combines the releasing mechanism and the sealing features in one single tool assembly to reduce the total length of the BHA. This makes it possible to pre-assemble the BHA offsite and send to the rig side as a single component.

The releasing tool as shown under FIG. 4*a* features an outer string, which will stay in hole, and the inner string, which will be tripped out of hole after the liner is set. The inner string and the outer string are temporarily connected by means of the locking splines 162. Variations in length due to temperature changes, and errors in manufacturing tolerances, are compensated for by the axial stroke of the suspension ub 48. The outer string includes the top sub 161 with the upper liner connection 164, the locking sub 173 and the cross over sub 175. The cross over sub 175 is connected to the lower outer Drilling Liner BHA. The inner string constituting the retrievable parts comprises of the pulling sleeve 171 including a fishable joint 160, the stop sleeve 174, the optional seal carrier 168, locking splines 162, a first mandrel 169 and a second mandrel 170. The second mandrel 170 is connected on it's lower end to the downhole motor 40. Shear screws 166 keeping the pulling sleeve 171 and the first mandrel 169 temporarily connected. Shear screws 171 do not transmit operational drilling loads. The stop sleeve 174 prevents the locking splines 162 from retracting. The inner and outer string are sealed against each other by means of high pressure seals 163 and 176.

When fishing the drilling liner inner string, the fishing string (not shown) is tripped in and connected to the pulling sleeve 171. The make up torque when applied is transmitted from the pulling sleeve 171 via a toothed connection to the first mandrel 169. When the fishing string is pulled, the shear screws 166 break, and the pulling sleeve 171 will move upwards until the stop sleeve 174 shoulders against the first mandrel 169. The seal carrier 168 build up a chamber to allow the locking splines 162 to retract. The locking splines 162 have inclined shoulders which generate a radial load on to the locking splines 162 when pulled. Continued pulling on the fishing string causes the locking splines 162 to retract. After the locking splines 162 are fully retracted, the inner string is disconnected from the outer string. The drilling liner can now be pulled out of hole along with the motor and the pilot bit. During the process of disconnection, mud circulates from the upper bypass port 172 into the inner string and out through the opened bypass port 167 of the first Mandrel 169. This reduces the surge and suction pressures.

The embodiment of FIGS. 3 and 4 has a number of advantages over the embodiment of FIGS. 1–2. The trip time may be reduced in certain applications. When no thruster is used, the bottom hole assembly does not have any additional hydraulic components. The bottom hole assembly can be preassembled and the spacings checked out before delivery to the rig site. A standard mud motor can be used without any special bearings. The total hook load is less by the amount of weight of the inner string. There is less of a pressure drop because the mud is not passing through the small inner string. Kick control might be improved in some applications when tripping in the inner string.

Figure 5A:
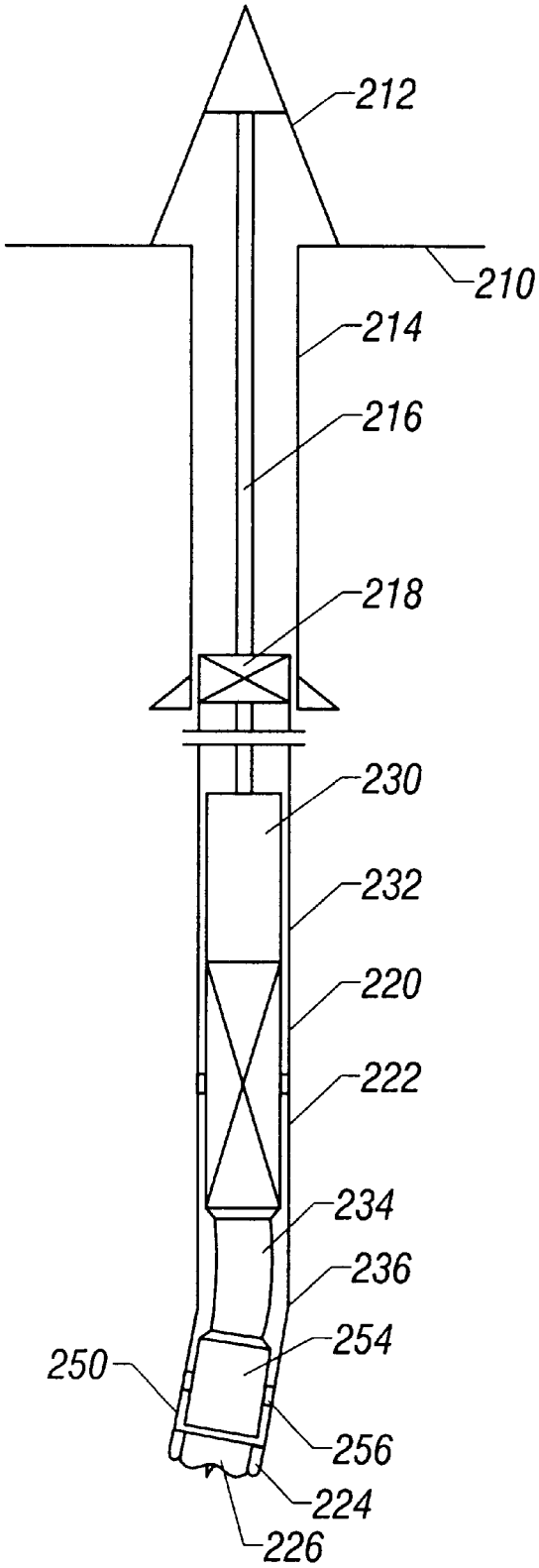
FIG. 5 is a schematic illustration of a system having a steerable drilling liner.

FIG. 5A shows an embodiment of a steerable Drilling Liner system with a steerable drilling liner. Shown is a rig 212 at the surface 208 of the earth. A casing 214 has been set in the upper portion of the borehole. A drilling tubular 216 passes through the casing to a liner hanger 218 at the bottom of the cased portion of the hole and carries a drilling liner-bottom hole assembly (DL-BHA) 222 at its lower end. The DL-BHA has, at its bottom end, a pilot bit 26 and a core bit 24. A liner 20 hangs from the liner hanger 18 at its top end is connected to the DL-BHA at its bottom end. These are as discussed above with reference to FIG. 1. The lower portion of the system has an MWD assembly 230 with a non-magnetic liner 232. The MWD assembly 230 offers directional control and can also provide information about the formation being traversed by it. This could include density, resistivity, gamma ray, NMR etc. measurements. The inner DL-BHA assembly 222 includes a flex shaft 234 between the motor and the male sub 254 and core bit 226. A radial bearing 256 supports the female sub 250 on the male sub 254 The liner 220 has a bent sub 236 that can be a fixed bend or an Adjustable Kick Off/bend Sub (AKO) making it possible to steer the liner under control of measurements from the MWD assembly 230. This device may also be used without an inner string between the DL-BHA and the liner hangers, similar to the arrangement discussed above with reference to FIG. 3.

Figure 5B:
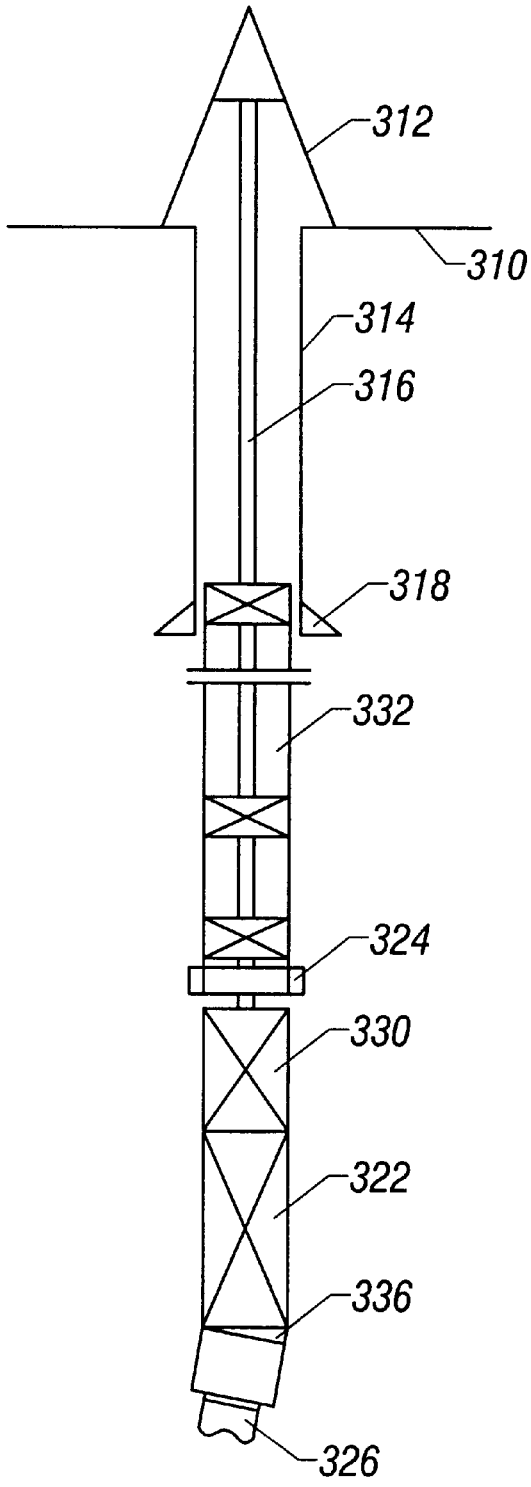

FIG. 5B shows a steerable Drilling Liner system that differs from the system shown in FIG. 5A in that the motor 322, MWD device 330 and optional LWD (logging while drilling) are extending out of the core bit 324. The inner string is centralized inside the liner via stabilizers. There is no non-magnetic liner required. Instead of the flex shaft, male sub and pilot bit a standard stabilized motor 322 (motor stabilization is not shown) with AKO sub 336 and standard drill bit 326 is used on bottom of the inner string. With the MWD/LWD assembly placed in the open hole, full service of geosteering is possible. Geosteering (density, resistivity, gamma ray, NMR etc. measurements) is used to steer along or in between formation boundaries.

Figure 6:
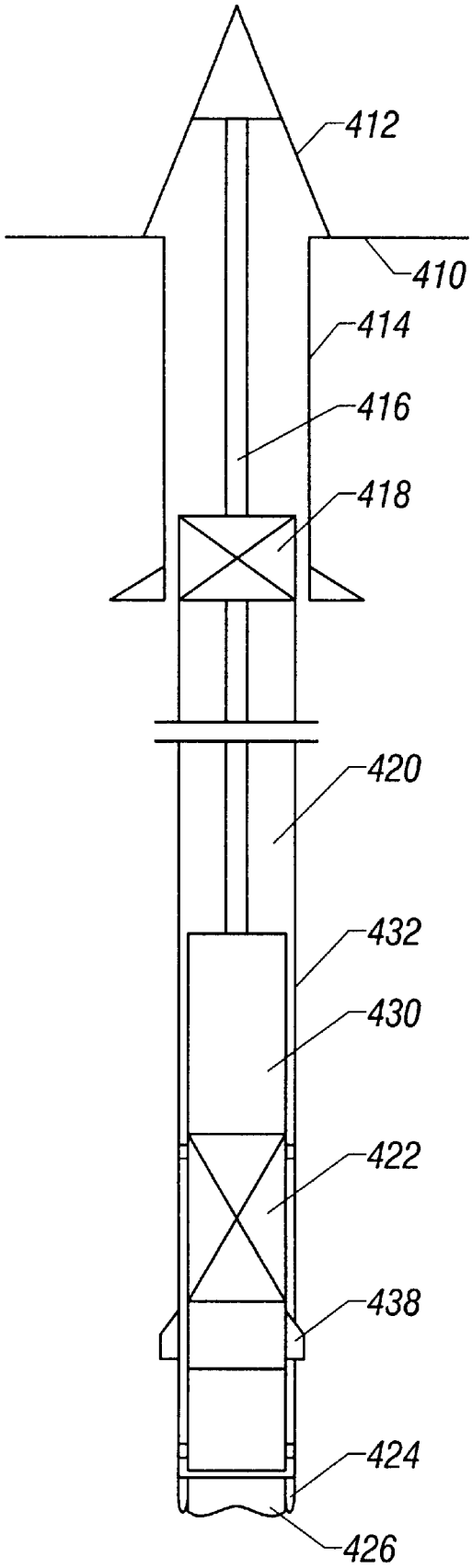
FIG. 6 is a schematic illustration of a system having a steerable drilling liner with steering pads on the liner.

Another arrangement of a steerable Drilling Liner system is shown in FIG. 6. Shown is a rig 412 at the surface 410 of the earth. A casing 414 has been set in the upper portion of the borehole. A drilling tubular 416 passes through the casing to a liner hanger 418 at the bottom of the cased portion of the hole and carries a drilling liner-bottom hole assembly (DL-BHA) 422 at its lower end. The DL-BHA has, at its bottom end, a pilot bit 426 and a core bit 424 A liner 420 hangs from the liner hanger 418 its top end is connected to the DL-BHA at its bottom end. These are as discussed above with reference to FIG. 1. The lower portion of the system has an MWD assembly 430 with a non-magnetic liner 432 The MWD assembly 430 offers directional control and can also provide information about the formation being traversed by it. This could include density, resistivity, gamma ray, NMR etc. measurements. The liner 420 can be steered downhole in inclination and azimuth by a steering system featuring retractable and expandable pads 438. In one embodiment of the invention, the pads 438 are on a non-rotatable sleeve. The liner is rotated within the sleeve whilst the sleeve is non-rotating. The sleeve itself features three or more pads which will be are loaded (expanded) or unloaded (retracted) to push the liner in the desired direction. The use of such a non-rotatable sleeve is would be known to those versed in the art. A commercial embodiment of this is the AUTOTRAK™ system of Baker Hughes and is not discussed further. An alternative is to use pads within the drilling liner. This device may also be used without an inner string between the DL-BHA and the liner hangers, similar to the arrangement discussed above with reference to FIG. 3.

An alternate embodiment of the device shown in FIG. 6 uses an expandable stabilizer located at a suitable position 438 on the BHA (the position can vary depending on the application and needs). With such an arrangement, the expandable stabilizer serves as a pivot point enabling steering of the assembly. The use of such an expandable stabilizer would be known to those versed in the art and is not discussed further.

Figure 7:
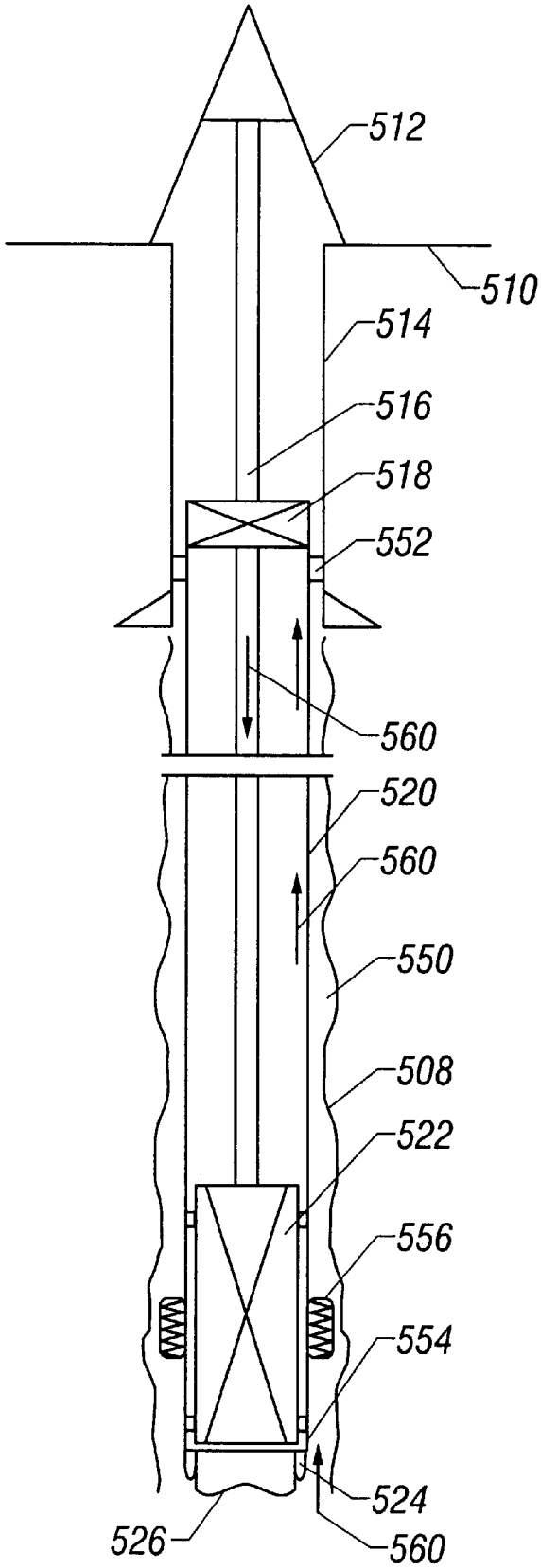
FIG. 7 is a schematic illustration of a drilling liner that isolates the formation from dynamic pressure variations.

FIG. 7 shows an embodiment of the invention using two additional packers. Shown is a rig 512 at the surface 510 of the earth in which a borehole 508 is drilled. A casing 514 has been set in the upper portion of the borehole. A drilling tubular 516 passes through the casing to a liner hanger 518 at the bottom of the cased portion of the hole and carries a drilling liner-bottom hole assembly (DL-BHA) 522 at its lower end. The DL-BHA has, at its bottom end, a pilot bit 526 and a core bit 524 A liner 520 hangs from the liner hanger 518 its top end is connected to the DL-BHA at its bottom end. These are as discussed above with reference to FIG. 1. Two additional packers are provided. One is a casing packer 552 just below the liner hanger 518. The other is an open hole packer 556 located close to the bit. The mud circulates in the direction indicated by 560, i.e., down the inner liner, out near the drill bit, back into the outer liner 520 through a port 554, through the annulus between the inner liner and the outer liner 520. The advantage of this invention is that there is no mud circulating in the annulus 550 between the outer liner 520 and the borehole 508, so that the open hole is not affected by the dynamic pressure of the circulated mud system. This reduces the contamination of the formation by the circulating mud.

This device may also be used with the steering arrangement (FIGS. 5A, 5B above) and with steerable pads (FIG. 6 above).

Figure 8:
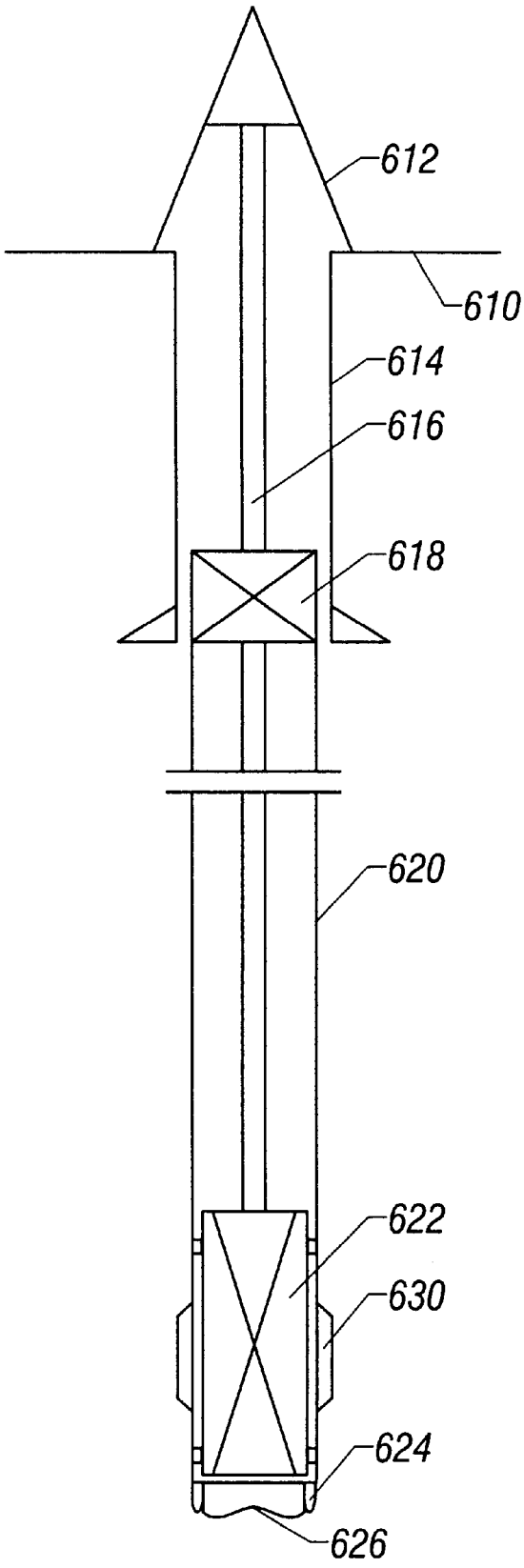
FIG. 8 is a schematic illustration of a drilling liner having an under-reamer.

FIG. 8 shows an arrangement using an under-reamer on the outside of the outer casing. Shown is a rig 612 at the surface 610 of the earth. A casing 614 has been set in the upper portion of the borehole. A drilling tubular 616 passes through the casing to a liner hanger 618 at the bottom of the cased portion of the hole and carries a drilling liner-bottom hole assembly (DL-BHA) 622 at its lower end. The DL-BHA has, at its bottom end, a pilot bit 626 and a core bit 624 A liner 620 hangs from the liner hanger 618 at its top end is connected to the DL-BHA at its bottom end. These are as discussed above with reference to FIG. 1. The under-reamer 630 is placed in the lower outer part of the liner 620. With the use of the under-reamer to enlarge the hole drilled by the core bit, it is possible to overcome slip-stick or differential sticking problems or to run an expandable casing. This device may also be used without the inner string (FIG. 3 above), with the steering arrangement (FIGS. 5A, 5B above) and with steerable pads (FIG. 6 above).

Figure 9:
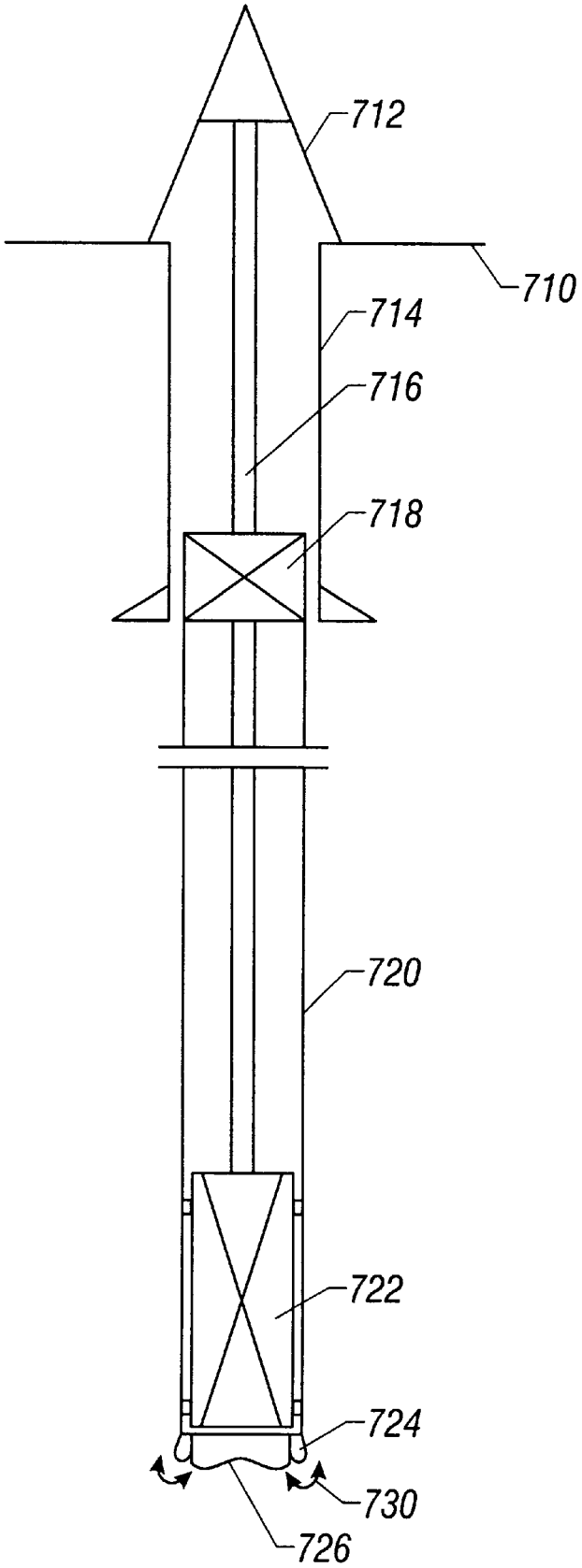
FIG. 9 is a schematic illustration of a drilling liner having an expandable core-bit.

FIG. 9 illustrates another embodiment of the invention. Shown is a rig 712 at the surface 710 of the earth. A casing 714 has been set in the upper portion of the borehole. A drilling tubular 716 passes through the casing to a liner hanger 718 at the bottom of the cased portion of the hole and carries a drilling liner-bottom hole assembly (DL-BHA) 722 at its lower end. The DL-BHA has, at its bottom end, a pilot bit 726 and a core bit 724. A liner 720 hangs from the liner hanger 726 at its top end is connected to the DL-BHA at its bottom end. These are as discussed above with reference to FIG. 1. The core bit 724 is expandable, ad indicated by the arrows 730. This makes it possible to expand the hole, making it possible to overcome stick-slip or differential sticking problems as well as to run an expandable casing. Alternatively, the pilot bit 726 may be made expandable, in which case, the core bit 724 is not necessary and the male sub with drive splines will not be required. The inner string may then be guided in a radial direction by means of stabilizer pads (not shown). This device may also be used without the inner liner (FIG. 3 above), with the steering arrangement (FIGS. 5A, 5B above), with steerable pads (FIG. 6 above) and with an under reamer (FIG. 7 above).

The invention discussed above with respect to FIGS. 1, 3, 5, 6 and 7 above may also be used with the use of a pilot bit including high pressure jet nozzles (not shown). The high fluid velocity exiting the nozzles washes the formation away to enlarge the hole size. The use of high pressure nozzles to wash out the formation would be known to those versed in the art and is not discussed further. With the use of such a special pilot bit, it is possible to overcome stick-slip or differential sticking problems as well as to run an expandable casing. In addition, with MWD measurements, the well may be deviated in a desired direction by the use of jet nozzles. This requires a system that allows mud flow through the nozzles in only one direction.

Figure 10:
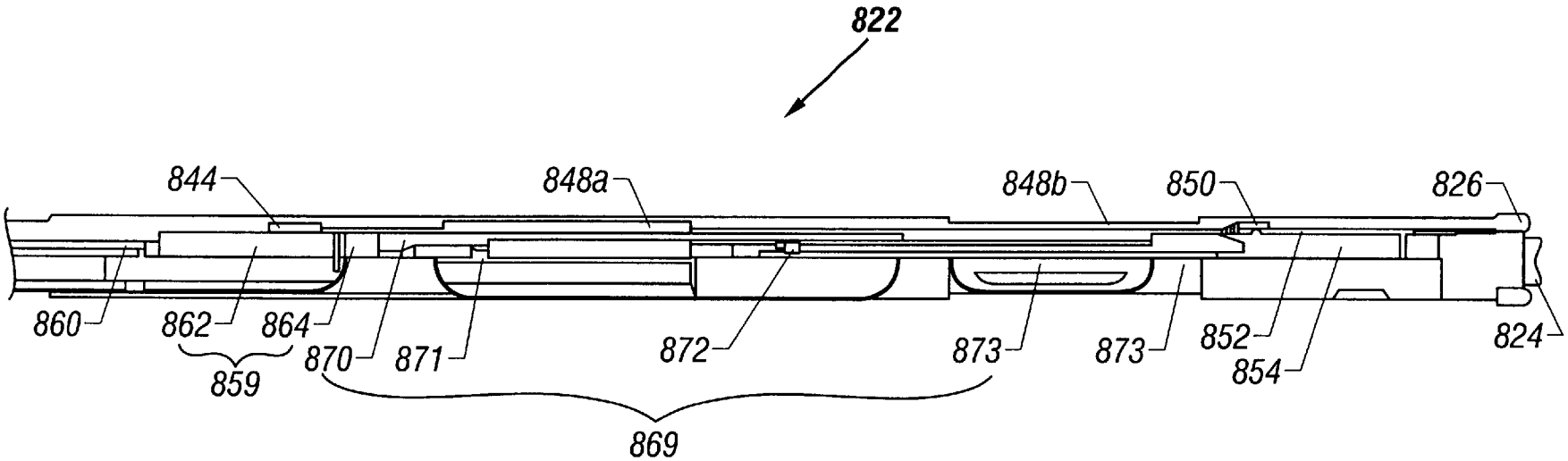
FIG. 10 is a schematic illustration of a bottom hole assembly having a thruster for continued drilling when the liner is stuck.

There are instances in the drilling of unusually pressured formations when the upper part of the outer liner gets stuck. In such instances, FIG. 10 provides a schematic illustration of a DL-BHA 822 where drilling may be continued with the drilling liner. To accomplish this, the inner portion of the DL-BHA has an additional thruster, referred to as the bottom thruster 869. The main parts of the bottom thruster are the cylinder 870, the position indicator 871, the piston 872 and the spline area 873. The main portions of the drilling motor 859 are indicated as: the landing splines 860, the bearing section 862 and the drive sub 864. The suspension sub has an inner and outer portion, labeled as 848*b* and 848*a* respectively. As in the device disclosed in FIG. 1, the male sub 854 is provided with drive splines 850 that engage the female sub 850. The pilot bit 824 is surrounded by the core bit 826 as in the other embodiments of the invention. The landing sub 844 couples the motor 859 to the suspension sub 848*a,* 848*b.*

Under normal drilling conditions, the core bit 826 is at the bottom of the hole at the same depth as the pilot bit 824. The bottom thruster is completely closed and the inner portion of the suspension sub 848*b* is fully telescoped inside the outer part 848*a,* of the suspension sub. If it some point the outer liner (not shown in FIG. 9) gets stuck at some point at or above the motor 859, the bottom thruster 869 is used to push the pilot bit 824 and the core bit 826 to continue drilling further into the formation until the thruster is fully extended. In such a system, the female 850 and male sub 854 are elongated by the stroke length of the bottom thruster 869 over what would normally be needed.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A drilling liner system for use in continued drilling of a borehole having a casing therein, the casing having a drilling tubular inside and a liner hanger/packer assembly at the bottom, the drilling liner system comprising:

(a) a tubular coupled to the drilling tubular and to an inner bottom hole assembly, the inner bottom hole assembly including:
  (i) a drilling motor coupled to the tubular and adapted to be operated by mud conveyed by said tubular; and
  (ii) a drive shaft on the drilling motor coupled to a male sub with retractable drive splines thereon, the male sub coupled to a pilot bit for drilling a pilot hole upon operation of the drilling motor; and (b) a liner coupled at a first end to the liner hanger/packer and at a second end to an outer bottom hole assembly, the outer bottom hole assembly including:
  (i) a female sub adapted to engage drive splines on the male sub and rotate with the male sub upon being engaged thereto, and
  (ii) a core bit surrounding the pilot bit and coupled to the female sub for drilling an enlarged hole.

2. The drilling liner system of claim 1 further comprising a landing sub with splines thereon for ensuring proper alignment of the inner bottom hole assembly and the outer bottom hole assembly.

3. The drilling liner system of claim 1 further comprising a suspension and bearing sub for providing longitudinal length suspension and radial guidance and isolating the rotation of the female sub from the liner.

4. The drilling liner system of claim 1 further comprising an MWD device having a non-magnetic liner in the tubular for providing directional measurements, and devices to facilitate directional drilling on the inner bottom hole assembly and the outer bottom hole assembly.

5. The drilling liner system of claim 4 wherein the devices to facilitate directional drilling further comprise (I) a flex shaft between the motor and the male sub, and, (II) a bent sub on the outer bottom hole assembly above the female sub, said bent sub selected from (i) an AKO, and (ii) a fixed angle.

6. The drilling system of claim 4 further comprising a casing packer located below the liner hanger/packer and an open hole packer located close to the core bit, said casing packer and open hole packer preventing the flow of drilling fluids into an annulus between the liner and the borehole.

7. The drilling system of claim 1 further comprising an MWD device in the inner bottom hole assembly to provide directional measurements, and a plurality of retractable pads on the outside of the outer bottom hole assembly, said retractable pads adapted to engage the borehole wall and guide the drilling system in a desired direction in inclination and azimuth.

8. The drilling system of claim 7 further comprising a casing packer located below the liner hanger/packer and an open hole packer located close to the core bit, said casing packer and open hole packer preventing the flow of drilling fluids into an annulus between the liner and the borehole.

9. The drilling system of claim 1 further comprising a casing packer located below the liner hanger/packer and an open hole packer located close to the core bit, said casing packer and open hole packer preventing the flow of drilling fluids into an annulus between the liner and the borehole.

10. The drilling system of claim 1 further comprising a reamer on the outside of the outer bottom hole assembly, said reamer adapted to enlarge the hole drilled by the core bit.

11. The drilling system of claim 1 wherein at least one of (i) the core bit, and (ii) the pilot bit is expandable.

12. The drilling system of claim 1 wherein the pilot bit further comprises high pressure jetting nozzles.

13. The drilling liner system of claim 1 wherein the drilling tubular is selected from the group consisting of (i) a drill pipe, and (ii) coiled tubing.

14. A drilling liner system for use in continued drilling of a borehole having a casing therein, the casing having a drilling tubular and a liner hanger/packer assembly at the bottom, the drilling liner system comprising:

(a) an inner bottom hole assembly including:
  (i) a drilling motor adapted to be operated by mud conveyed downhole by the drilling tubular; and
  (ii) a drive shaft on the drilling motor coupled to a male sub with retractable drive splines thereon, the male sub coupled to a pilot bit for drilling a pilot hole upon operation of the drilling motor;

(b) a liner coupled at a first end to the liner hanger/packer and the drilling tubular, and at a second end to an outer bottom hole assembly, the outer bottom hole assembly including:
  (i) a female sub adapted to engage the drive splines on the male sub and rotate with the male sub upon being engaged thereto, and
  (ii) a core bit surrounding the pilot bit and coupled to the female sub for drilling an enlarged hole; and (c) a releasing tool for releasably coupling the inner bottom hole assembly to the liner.

15. The drilling liner system of claim 14 further comprising a fishable joint on the releasing tool for facilitating retrieval of the inner bottom hole assembly from the borehole.

16. The drilling liner system of claim 14 further comprising an MWD device in the inner bottom hole assembly to provide directional measurements and devices on the inner and outer bottom hole assemblies to facilitate directional drilling.

17. The drilling system of claim 14 further comprising an MWD device in the inner bottom hole assembly to provide directional measurements, and a plurality of retractable pads on the outside of the outer bottom hole assembly, said retractable pads adapted to engage the borehole wall and guide the drilling system in a desired direction in inclination and azimuth.

18. The drilling system of claim 14 further comprising a casing packer located below the liner hanger/packer and an open hole packer located close to the core bit, said casing packer and open hole packer preventing the flow of drilling fluids into an annulus between the liner and the borehole.

19. The drilling system of claim 14 further comprising a reamer on the outside of the outer bottom hole assembly, said reamer adapted to enlarge the hole drilled by the core bit.

20. The drilling system of claim 14 wherein at least one of (i) the core bit, and (ii) the pilot bit is expandable.

21. The drilling system of claim 14 wherein the pilot bit further comprises high pressure jetting nozzles.

22. The drilling liner system of claim 14 wherein the drilling tubular is selected from the group consisting of (i) a drill pipe, and (ii) coiled tubing.

23. A drilling liner system for use in continued drilling of a borehole having a casing therein, a drilling tubular inside the casing, and a liner hanger/packer assembly at the bottom of the casing, the drilling liner system comprising:

(a) a tubular coupled to the drilling tubular and to an inner bottom hole assembly, the inner bottom hole assembly including:
  (i) a drilling motor coupled to the tubular and adapted to be operated by mud carried by said tubular;
  (ii) a thruster coupled to a drive shaft on the drilling motor and to a male sub, the thruster adapted to extend and retract the position of the male sub relative to the drilling motor (iii) retractable drive splines on the male sub, and (iv) a pilot bit coupled to the male sub for drilling a pilot hole upon operation of the drilling motor; and (b) a liner coupled at a first end to the liner hanger/packer and at a second end to an outer bottom hole assembly, the outer bottom hole assembly including:

(i) a female sub adapted to engage drive splines on the male sub and rotate with the male sub upon being engaged thereto, (ii) a core bit surrounding the pilot bit and coupled to the female sub for drilling an enlarged hole, and (iii) a telescopic suspension sub coupled to the drilling motor and the female sub, said telescopic sub adapted to move the female sub in conjunction with the motion of the thruster.

24. A method of drilling a borehole comprising:

(a) setting a casing in a section of the borehole;

(b) passing a drilling tubular through the casing and a liner hanger/packer assembly at the bottom of the casing;

(c) operating a drilling motor coupled to a lower end of the tubular by passing mud carried by said tubular;

(d) coupling a first end of a liner to the liner hanger/packer and at a second end to an outer bottom hole assembly;

(e) coupling a drive shaft on the drilling motor to a male sub with retractable drive splines thereon and to a pilot bit for drilling a pilot hole upon operation of the drilling motor;

(f) engaging a female sub on the outer bottom hole assembly to the drive splines on the male sub and rotating with the male sub upon being engaged thereto, thereby operating a core bit on the outer bottom hole assembly for drilling an enlarged hole.

25. The method of claim 24 further comprising using an MWD device in the tubular for providing directional measurements, and using such directional information on devices on the inner bottom hole assembly and the outer bottom hole assembly for directional drilling.

26. The method of claim 24 further comprising using an MWD device in the inner bottom hole assembly to provide directional measurements, and using a plurality of retractable pads on the outside of the outer bottom hole assembly to engage the borehole wall and guide the pilot bit and the core bit in a desired direction in inclination and azimuth.

27. The method of claim 24 further comprising using a casing packer located below the liner hanger/packer and an open hole packer located close to the core bit for preventing the flow of drilling fluids into an annulus between the liner and the borehole.

28. The method of claim 24 further comprising a using reamer on the outside of the outer bottom hole assembly, said reamer adapted to enlarge the hole drilled by the core bit.

29. The method of claim 24 wherein at least one of (i) the core bit, and (ii) the pilot bit is expandable.

30. The method of claim 24 further comprising using high pressure jetting nozzles on the core bit to facilitate drilling.

31. The method of claim 24 further comprising using a thruster on the inner bottom hole assembly to move the male sub relative to the drilling motor and using a telescopic suspension sub on the outer bottom hole assembly to maintain engagement between the female sub and the drive splines on the male sub.

32. A method of drilling a borehole comprising:

(a) setting a casing in a section of the borehole;

(b) coupling a first end of a liner to a liner hanger/packer at the bottom of the casing;

(c) coupling a second end of the liner to an outer bottom hole assembly having a core bit thereon;

(d) using a releasing tool to couple the outer bottom hole assembly to an inner bottom hole assembly having a mud motor therein;

(e) coupling a drive shaft on the drilling motor to a male sub with retractable drive splines thereon and to a pilot bit for drilling a pilot hole upon operation of the drilling motor;

(f) engaging a female sub on the outer bottom hole assembly to the drive splines on the male sub thereby enabling the core bit to drill an enlarged hole upon operation of the drilling motor;

(g) conveying mud through a drilling tubular in the casing through the liner hanger/packer into the liner and using the mud to operate the drilling motor, thereby causing the pilot bit to drill a pilot hole and the core bit to drill an enlarged hole.

33. The method of claim 32 further comprising operating the releasing tool to decouple the inner bottom hole assembly from the outer bottom hole assembly, and using a fishing hook on the inner bottom hole assembly to retrieve the inner bottom hole assembly from the borehole.

* * * * *